US008856981B1

(12) United States Patent
Rayess et al.

(10) Patent No.: US 8,856,981 B1
(45) Date of Patent: Oct. 14, 2014

(54) STABILITY CONTROLLED ASSISTIVE LIFTING APPARATUS

(75) Inventors: Nassif E. Rayess, Warren, MI (US); Sandra A. Yost, Detroit, MI (US); Obafemi Osunfisan, Hazel Park, MI (US); Raymond Slowik, Royal Oak, MI (US); Mark Fazi, Clawson, MI (US)

(73) Assignee: University of Detroit Mercy, Detroit, MI (US)

( * ) Notice: Subject to any disclaimer, the term of this patent is extended or adjusted under 35 U.S.C. 154(b) by 428 days.

(21) Appl. No.: 13/282,075

(22) Filed: Oct. 26, 2011

Related U.S. Application Data

(60) Provisional application No. 61/406,778, filed on Oct. 26, 2010.

(51) Int. Cl.
*A61G 5/04* (2013.01)

(52) U.S. Cl.
USPC ..... 5/83.1; 5/89.1

(58) Field of Classification Search
USPC ..... 5/83.1, 89.1, 87.1, 652, 904, 940
See application file for complete search history.

(56) References Cited

U.S. PATENT DOCUMENTS 7,802,328 B2 * 9/2010 Lingegard ..... 5/83.1

* cited by examiner

*Primary Examiner* — Fredrick Conley
(74) *Attorney, Agent, or Firm* — Carrier Blackman & Associates, P.C.; Joseph P. Carrier; Anne Marie Mazzara

(57) ABSTRACT

A stability controlled assistive lifting harness apparatus is provided which includes a frame, an actuator attached to said frame, a lifting harness configured to support a user and to be raised and lowered by said actuator, said lifting harness being provided with at least one surface pressure sensor located within the lifting harness which measures a force applied to a user by the lifting harness, a harness tension sensor which measures a force applied to the lifting harness by said motor, and a controller which receives outputs from said surface pressure sensor and said harness tension sensor and controls operation of said actuator based on the outputs of the surface pressure sensor and the harness tension sensor. The controller controls operation of the actuator from moving a user between said positions.

11 Claims, 4 Drawing Sheets

STABILITY CONTROLLED ASSISTIVE LIFTING APPARATUS

CROSS-REFERENCE TO RELATED APPLICATIONS

The present application claims priority under 35 USC §119 based on U.S. Provisional Application No. 61/406,778, filed on Oct. 26, 2010. The entire subject matter of this priority document is herein incorporated by reference.

BACKGROUND OF THE INVENTION

1. Field of the Invention

The present invention relates generally to assistive personal lifting equipment. More specifically, the present invention relates to a stability controlled assistive lifting apparatus, for helping a person with limited ambulatory movement to reach a standing position, without human assistance.

2. Description of the Background Art

There are many individuals who suffer from limited mobility by reason of disability, disease, or advanced age. A common problem exists for such persons when they need or wish to move to an upright position from the floor or from a sitting position, or vice-versa. An individual may have fallen or may have voluntarily moved to a sitting position on the floor, and may have a difficult time getting back to an upright position so he or she may stand up. A fall is an obvious situation, but other situations exist that can be inconvenient or embarrassing for a person who is disabled, for instance, where a person has voluntarily placed him or herself down on the floor, but cannot get back up without assistance. Also, there are situations where it is desirable to move in a controlled manner, gradually from a standing position down to the floor.

A device is also needed that will assist attendants and helpers to facilitate moving a disabled person, who is located on the floor or in a sitting position and wants to stand up, or vice-versa. The task of moving a patient from the floor or a sitting position to an upright position can be extremely difficult for one person, particularly considering frailty and or weight factors for a particular patient.

There are a variety of technologies that have attempted to assist with lifting/standing of an individual, however, the existing technologies either do not deal with the specific problem, or they employ means to deal with the problems that are inadequate because they are either excessively complicated, bulky, expensive or difficult to use.

Other patents focused on improving personal mobility include: U.S. Pat. No. 6,070,278 (1996) to Smith (a hydraulic powered chair for use in a swimming pool); U.S. Pat. No. 5,802,638 (1998) to Parker (a hydraulic chair-bed); U.S. Pat. No. 5,484,151 (1996) to Tholkes (a mobile standing aid that moves a person from seated to standing position); U.S. Pat. No. 5,341,525 (1994) to Tillman (a shower lounge chair); U.S. Pat. No. 5,800,016 (1998) to Allred (a elevating, motorized chair); U.S. Pat. No. 4,420,286 (1983) to Hanson (a vehicle mounted invalid lift apparatus); U.S. Pat. No. 6,276,007B1 (2001) to Brown (a pole styled lift device); U.S. Pat. No. 5,189,741 (1993) to Beardmore (a device for standing up a sitting person from a seated position); U.S. Pat. No. 5,327,592 to Stump (a stationary patient lift that relies on a hoist apparatus to lift disabled persons); U.S. Pat. No. 5,802,633 (1998) to Capaldi (hoist apparatus); and U.S. Pat. No. 5,090,072 (1992) issued to Gray (a similar belt styled device).

All of the above-listed patents include various features and inventions which may be used to assist in lifting/assisting disabled persons, however, they generally use different means, frequently complicated hoist mechanisms, gears, chains, or guiding frames that are not suitable for everyday use, or that require the use of a device separate from the devices used to aid in mobility. Although the known devices have some utility for their intended purposes, a need still exists in the art for an improved personal lifting and lowering apparatus. In particular, there is a need for an improved personal lifting apparatus which will overcome the difficulties encountered with the known art.

SUMMARY OF THE INVENTION

Accordingly, the present invention has been made to overcome the drawbacks of the previously known lifting apparatus. It is an object of the present invention to provide an assistive lifting apparatus for assisting a person with limited ambulatory movement in reaching a standing position and which is safely actuated based on determined stability of the assisted person relative to the apparatus.

It is a further object of the present invention to provide such a stability controlled assistive lifting apparatus which can actively lift a person with limited ambulatory movement to reach a standing position without the assistance of another person or persons, and which also can be used to assist the person with limited ambulatory movement in walking or the like.

It is a further object of the present invention to provide a stability controlled assistive lifting apparatus which provides a lifting force proportional to the lifting effort of the user.

It is still a further object of the present invention to provide a stability controlled assistive lifting apparatus that allows the user to divert one's diminished strength towards stabilizing oneself.

It is still a further object of the present invention to provide a stability controlled assistive lifting apparatus that senses the side-to-side movement and front-to-back tilt/movement of the user in order to ensure that the user is properly positioned within the assistive lifting harness apparatus throughout operation of the apparatus.

It is a further object of the present invention to provide a stability controlled assistive lifting apparatus that uses a differentially controlled actuators to aid correct the side-to-side instability of the user.

It is a further object of the present invention to provide a stability controlled assistive lifting apparatus that requires the harness sensors register even and symmetric distribution of the user's weight in order to be activated.

It is a further object of the present invention to provide a stability controlled assistive lifting apparatus that stops activation/actuation if pressure sensors register front to back tilting commensurate with falling.

It is a further object of the present invention to provide a stability controlled assistive lifting apparatus that activates only after handgrip sensors indicate that the user is in firm contact with handholds.

It is a further object of the present invention to provide a stability controlled assistive lifting apparatus that stops activation/actuation if handgrip sensors register that a user is no longer in firm contact with handholds.

It is a further object of the present invention to provide a stability controlled assistive lifting apparatus that allows a user to lower oneself to a seated position.

The objects of the present invention are achieved and the disadvantages of the prior art are overcome by the present invention which provides a stability controlled assistive lifting apparatus comprising a frame, an actuator attached to said frame, a lifting harness configured to support a user and to be raised and lowered by said actuator, the lifting harness being provided with at least one surface pressure sensor located within the lifting harness which measures a force applied to a user by the lifting harness, a harness tension sensor which measures a force applied to the lifting harness by said actuator, and a controller which receives outputs from said sensors and controls operation of said actuator based thereon. The lifting harness may be selectively fitted to various body parts of a user who is in a standing or reclined position. The controller controls operation of the actuator from moving a user between reclined and upright positions, and interrupts operation of the actuator when it is determined, based on the outputs of the surface pressure sensor and the harness tension sensor, that a user is not safely positioned relative to the lifting harness.

There have thus been outlined, rather broadly, some of the features of the invention in order that the detailed description thereof may be better understood, and in order that the present contribution to the art may be better appreciated. There are additional features of the invention that will be described hereinafter.

Other objects, advantages and salient features of the present invention will become apparent to the skilled artisan with reference to the exemplary embodiments of the invention discussed hereafter with reference to the appended drawings. To accomplish the above and related objects, this invention may be embodied in the form illustrated in the accompanying drawings, attention being called to the fact, however, that the drawings are illustrative only, and that changes may be made in the specific construction illustrated and described within the scope the claimed invention.

DETAILED DESCRIPTION OF THE ILLUSTRATIVE EMBODIMENT

Figure 1:
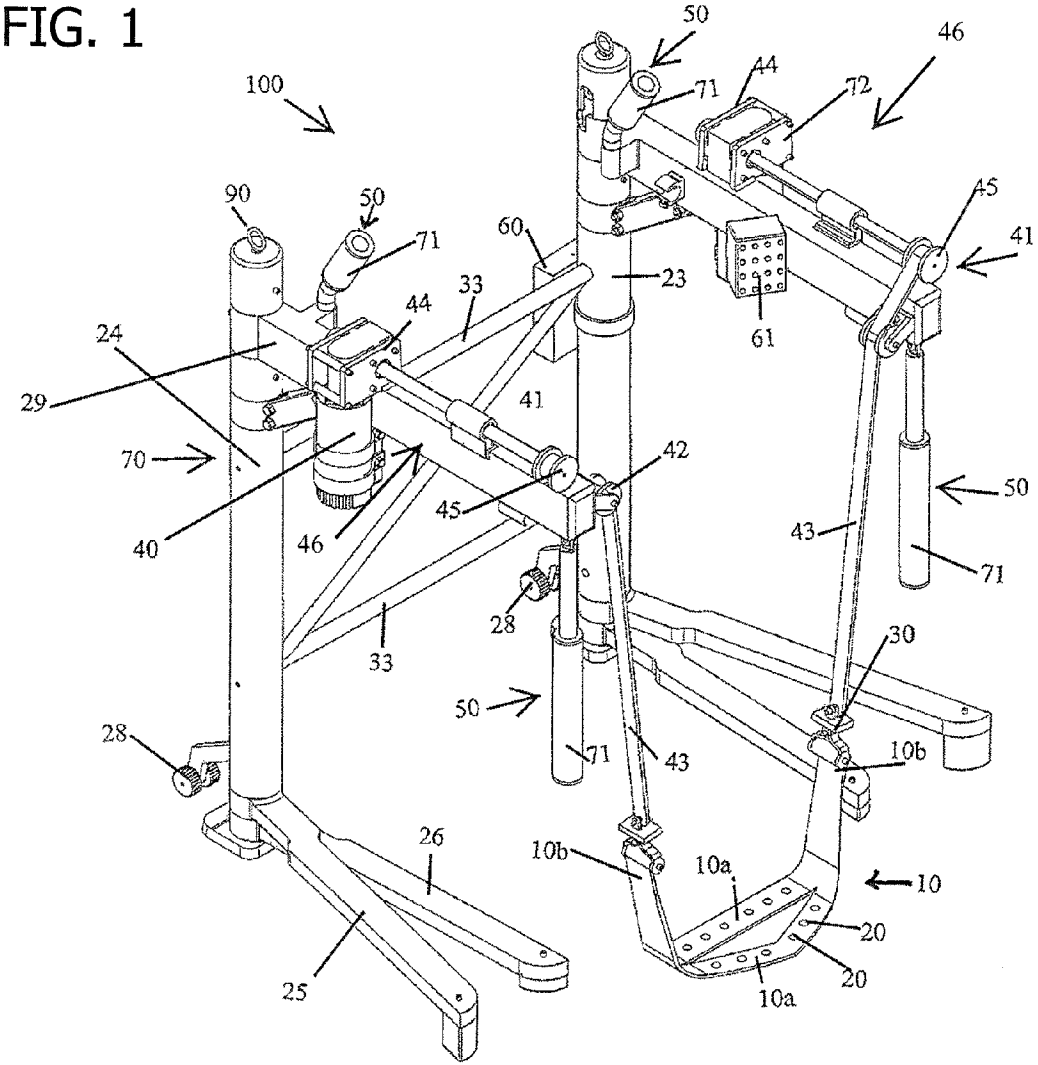
FIG. 1 is an upper perspective view of a stability controlled assistive lifting apparatus according to an illustrative embodiment of the present invention.

An illustrative embodiment of the present invention will now be described in detail, with reference to the accompanying drawings. It should be understood that only structures considered necessary for clarifying the present invention are described herein. Other conventional structures, and those of ancillary and auxiliary components of the system, will be known and understood by those skilled in the art. Throughout the following detailed description and in the drawings, like numbers refer to like parts.

Figure 2:
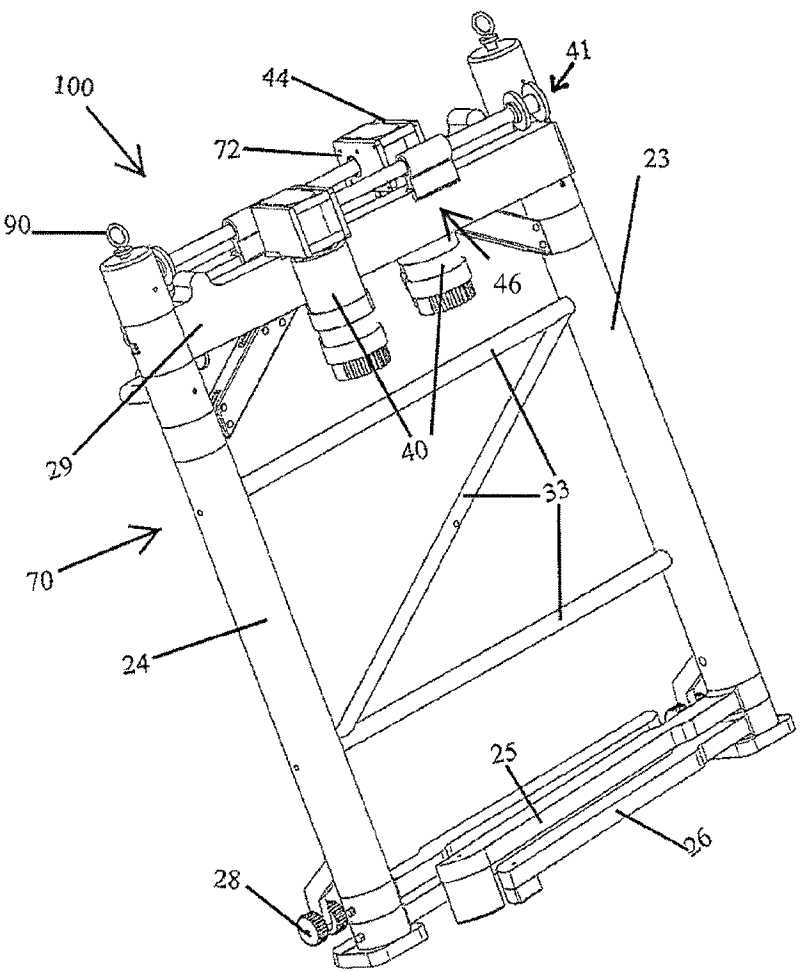
FIG. 2 is an upper perspective view of the stability controlled assistive lifting apparatus of FIG. 1 showing the stability controlled assistive lifting apparatus in a folded state.
Figure 3:
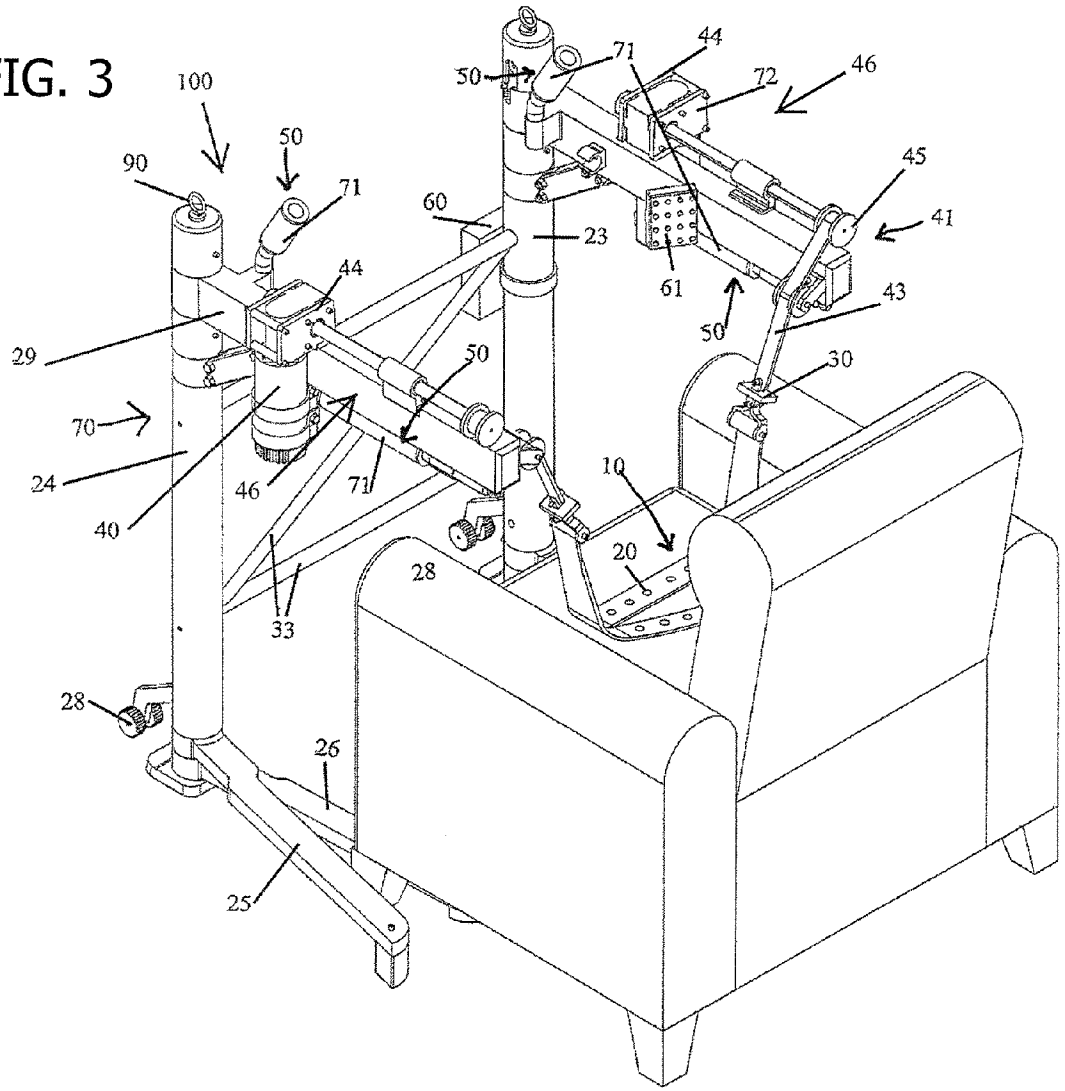
FIG. 3 is an upper perspective view of the stability controlled assistive lifting apparatus of FIG. 1 showing the stability controlled assistive lifting apparatus when used with a chair.

Referring now to the FIGS. 1-3, there is shown a stability controlled assistive lifting apparatus according to an illustrative embodiment of the present invention. The lifting harness apparatus is generally denoted by reference numeral 100, and includes a frame 70, a lifting harness 10, a plurality of surface pressure sensors 20, harness tension sensors 30, and grip sensors 50, respectively, an electronic control unit (ECU) 60, and actuator(s) 46 which are controlled by the ECU 60 to effect assisting operations of the apparatus. The stability controlled assistive lifting apparatus may be considered automatic or semi-automatically controlled.

Frame

The frame 70 is the physical structure on which the various physical subsystems of the invention attach. The frame 70 provides locations for motor mounts 72 as well as a number of handholds 71. The frame 70 is a central element that allows core technology of the invention to be configured to help a user to an upright position from a reclined position on the floor, chair or bedside, and vice versa among other possibilities.

In the depicted embodiment, the frame 70 includes a pair of spaced apart main frame members 23, 24. The main frame members 23, 24 are interconnected by at least one bridge member 33 which is situated at a rear portion of the frame 70, so as not interfere with a user during operation of the apparatus. Extending from the top portion of each of the main frame members 23, 24 are upper arms 29 which may be rotatably supported by the main frame member 23, 24. Extending from the bottom portion of each of the main frame members 23, 24 are legs 25, 26, which may extend outwardly therefrom, as shown, which are arranged to stabilize the assistive lifting harness apparatus 100. The legs 25, 26 may be rotatably attached to the main frame members 23, 24 such that the legs 25, 26 may be rotated a positioned in order to provide the greatest stability to the assistive lifting harness apparatus. For example, the legs 25, 26 may be positioned such that they can be fitted closely relative to a chair, a couch, a bed, etc. during use. The frame 70 may be provided with wheels 28 extending from the bottom portion of the main frame members 23, 24 in a direction opposite that of the legs 25, 26. The wheels 28 may be used to help place the assistive lifting harness apparatus in the proper position to assist the user.

The frame may be provided with several sets of handholds 71 in order to facilitate use of the assistive lifting harness apparatus from several starting positions. For example, in the depicted embodiment, two separate sets of handholds 71 are shown, with a first set of handholds 71 extending from a bottom end portion of each upper arm 29 away from the main frame members 23, 24 and a second set of handholds 71 extending from a top end portion of each upper arm 29 closest to the main frame members 23, 24.

During use of the assistive lifting harness apparatus, the upper arms 29, the legs 25, 26 and the handholds 71 may be locked in place in order that they do not move during use of the apparatus. In order to more easily and quickly move/maneuver the assistive lifting harness apparatus of the present invention, the upper arms 29, the legs 25, 26 and the handholds 71 may be folded as shown in FIG. 2. Further, since the frame 70 can be folded to a more compact state, it allows the assistive lifting harness apparatus 100 to be more easily stored. In order to fold the upper arms 29 and the legs 25, 26, a lock pin 90 may be manipulated such that the upper arms 29 and the legs 25, 26 can be folded inwardly, e.g., when the lock pin 90 is pulled upwardly, the upper arms 29 and the legs 25, 26 are free to be rotated around the main frame members 23, 24 and can be folded inwardly. When the lock pin 90 is pushed inward, the upper arms 29 and the legs 25, 26 are locked in position. While it is depicted that a lock pin is used to lock the upper arms 29 and the legs 25, 26 in place, other appropriate locking mechanisms can be used.

The frame includes a plurality of interconnected structural elements or sections that may be provided to provide a stable footing against tipping and a somewhat rigid attachments to anchor the motors 40 and/or pulleys 41. The frame 70 swingably supports the lifting harness 10, through the pulleys 41 and the lifting straps 43.

Lifting Harness

The lifting harness 10 includes a wide flexible surface for contacting the back side of a user, in an area extending from the back of the upper legs to the upper back. The lifting harness 10 includes at least one individual lifting surface 10*a*, and may include additional lifting surfaces, depending on the needs and condition of the user and the posture from which the lifting is initiated. The lifting harness 10 may be provided with a plurality of surface pressure sensors 20, which measure the pressure between being applied by the user on the harness.

The lifting harness 10 may also be provided with two harness tension sensors 30, used to measure the lifting forces exerted on the left and right sides of the harness. The lifting harness 10 is provided to apply an assistive lifting force on the back side of the user, in order to help the user elevate to a standing position or for the purpose of transitioning between postures, i.e. a sitting position, a standing position, a crouching position, etc. Alternatively, the lifting harness 10 may be used to lower the user from a standing position to a seated position on a chair, floor or other surface, as needed.

The lifting harness 10 may include a webbed belt-like construction made of a strong, flexible yet inextensible fabric material similar to the material used for automotive seat belts.

While the lifting harness 10 may be provided with only a single individual lifting surface 10*a*, alternatively, the lifting harness 10 may, instead, consist of two or more individual lifting surfaces 10*a* connected together to provide a wider contact area or a more contoured surface.

Surface Pressure Sensors

As noted above, the inside surface of the lifting harness 10 may be provided with a plurality of surface pressure sensors 20, used to measure the contact pressure and subsequently the force between the user and the harness. The pressures sensed by the respective surface pressure sensors are input into a control algorithm in the ECU 60 which may use the same in order to set a motor winching speed, as well as to ensure that the user does not experience excessive pressure, i.e. pressure great enough to cause damage to the skin and muscle of the user, as discussed further below.

The surface pressure sensors 20 are preferably contact pressure sensing elements. The surface pressure sensors 20 may be located on the inside surface of the lifting harness 10 which contacts the user. The surface pressure sensors 20 determine the amount of lifting force being exerted on the user. The surface pressure sensors 20 may, for example, consist of discrete point force sensors or one or more distributed force sensors. The surface pressure sensors 20 may be used to ensure proper weight distribution of the user before initiating lifting of the user and throughout the lifting operation. The weight distribution can be used to ascertain the posture of the user, e.g. whether the user is not sitting in the center of the lifting harness 10 or whether the left or right side of the user is located vertically higher than the other. The weight distribution information is then input to the control algorithm.

The surface pressure sensors 20 are preferably capacitive or any other ultra low profile sensor elements capable of recording contact forces or pressures. While the illustrative embodiment shows a specific placement of the surface pressure sensors 20, the location and distribution of the sensors may vary so long as a pressure distribution profile along the entire length of the lifting harness 10 can be constructed in an appropriate manner necessary for a desired application of the apparatus.

Harness Tension Sensors

The harness tension sensors 30 are preferably load cell type sensors located at both end portions 10*b* of the lifting harness 10 between the end portion 10*b* of the lifting harness 10 and the lifting straps 43. The harness tension sensors 30 determine the overall weight of the user as well any lifting force being exerted by the user. The lifting force being exerted by the user may be determined by subtracting the measured weight during operation of the lifting harness from the initial weight measured prior to operation of the lifting harness.

The harness tension sensors 30 may be used to determine the intention of the user (e.g., the force being exerted by the lifting harness 10 and speed of the lifting harness 10 during operation) as well as to determine the transient condition of the user, particularly things related to loss of control. For example, a side-to-side loss of control may be determined wherein one harness tension sensor 30 measures a higher load than the other harness tension sensor 30. A fore-aft loss of control may be revealed by a rapid change in the load profile due to sudden weight transfer into the arms and/or legs of the user. The outputs from the harness tension sensors 30 may be input to the control algorithm to determine the user intention information and information regarding the transient condition of the user.

Grip Sensors

The grip sensors 50, located in the handholds 70, may determine whether user is holding properly onto or otherwise properly supported by the designated handholds 71. If the grip sensors sense that a user has let go of one or both of the handholds 71, the ECU 60 can send a signal to stop the motors 40 thereby stopping the movement of the lifting harness 10.

The grip sensors 50 are preferably capacitive type sensors such as those used on exercise equipment to monitor heart rate and may be used to indicate the firmness of the grip of the operator. However, the grip sensors 50 may be force or pressure sensors that indicate magnitude and direction of the forces exerted by the user's hands.

The signals from the grip sensors 50 may be input to the control algorithm to determine whether or not the user is properly in control, and to ensure that the operator is holding on to the frame at certain locations that are deemed safe. Further, the signals coming from the grip sensors 50 could be used by the control algorithm to supplement the signals from the surface pressure sensors 20 and the harness tension sensors 30.

Actuators

The actuators 46 include the motors 40, the pulleys 41 and the transmission mechanisms (not shown), which transmit the output of the motors 40 to the pulleys 41. The transmission mechanism may be, for example, a gear which may be used to step up or step down the output from the motors 40 before it is transmitted to the pulleys 41. The motors 40 may be equipped with self-locking reducers and engage a pulley 41 on which a strap 43, attached to the end portion 10*b* of the lifting harness 10, is spooled. As the motors engage, the strap 43 is spooled around the spool 45 in order to raise the lifting harness 10 thereby lifting the user. Reversing the running direction of the motors 30 will unspool the straps 43 thereby the lifting harness 10 and subsequently lowering the user. The self-locking speed reducer can ensure that no unintended motion occurs. A position encoder 42 may be used to determine the location of the harness at all times. Preferably the motors 40 are DC motors with self-locking gear heads, although the motors 40 could consist of any variation of motors and gear heads.

While the motors 40 are shown to be located at the top of the frame with the strap being spooled onto the spool 45 of the pulley 41, the motors could be located at a different position, e.g. near the bottom of the frame 70, with the raising and lowering of the lifting harness 10 being transferred through idler pulleys.

Controller

The signals from the surface pressure sensors 20, the harness tension sensors 30 and the grip sensors 50 may be input to the ECU 60. The ECU 60 may use these input signals and execute a control algorithm 80 to control the speed of the motors 40, and subsequently, the speed with which the user is being lifted.

The ECU 60 is preferably a micro-controller type device capable of measuring analog or digital signals, as appropriate, and capable of generating output voltages. The micro-controller may further be augmented with signal conditioning circuitry as well as motor speed controllers.

Operation of the Illustrative Embodiment

As discussed above, the lifting harness 10 may be provided with surface pressure sensors 20 that are either attached to the surface of the lifting harness 10 or are embedded inside the lifting harness 10 along the lifting surfaces 10*a*. The surface pressure sensors 20 may be powered by a signal conditioning circuit 22 that also conditions the signal and readies it for acquisition by the ECU 60. The signals from the surface pressure sensors 20 may be used to determine the position and posture of the user through the human/machine interface 61.

The end portions 10*b* of the lifting harness 10 may connect to the harness tension sensors 30 through hooks or the like. The opposite end of the harness tension sensors 30 are then connected to the lifting straps 43 through similar mechanisms (hooks or the like). As such, the harness tension sensors 30 are disposed between the end portions 10*b* of the lifting harness 10 and the end portions 43*a* of the lifting straps 43. The harness tension sensors 30 may comprise the sensor 31 as well as a signal conditioning circuit 32 which provides power to and conditions the signals from the sensors.

The straps are wound around the spools 45 of the pulleys 41 that are connected to the output shafts of the motors 40. The motors may be attached through a base 44 to the frame 70 at motor mounts 72 which may be located either at the top portion of the frame 70 as shown in the accompanying figures or at any other location on the frame 70 where idler pulleys could be used to guide the straps. The frame may include designated handholds 71 where grip sensors 50 are installed.

Figure 4:
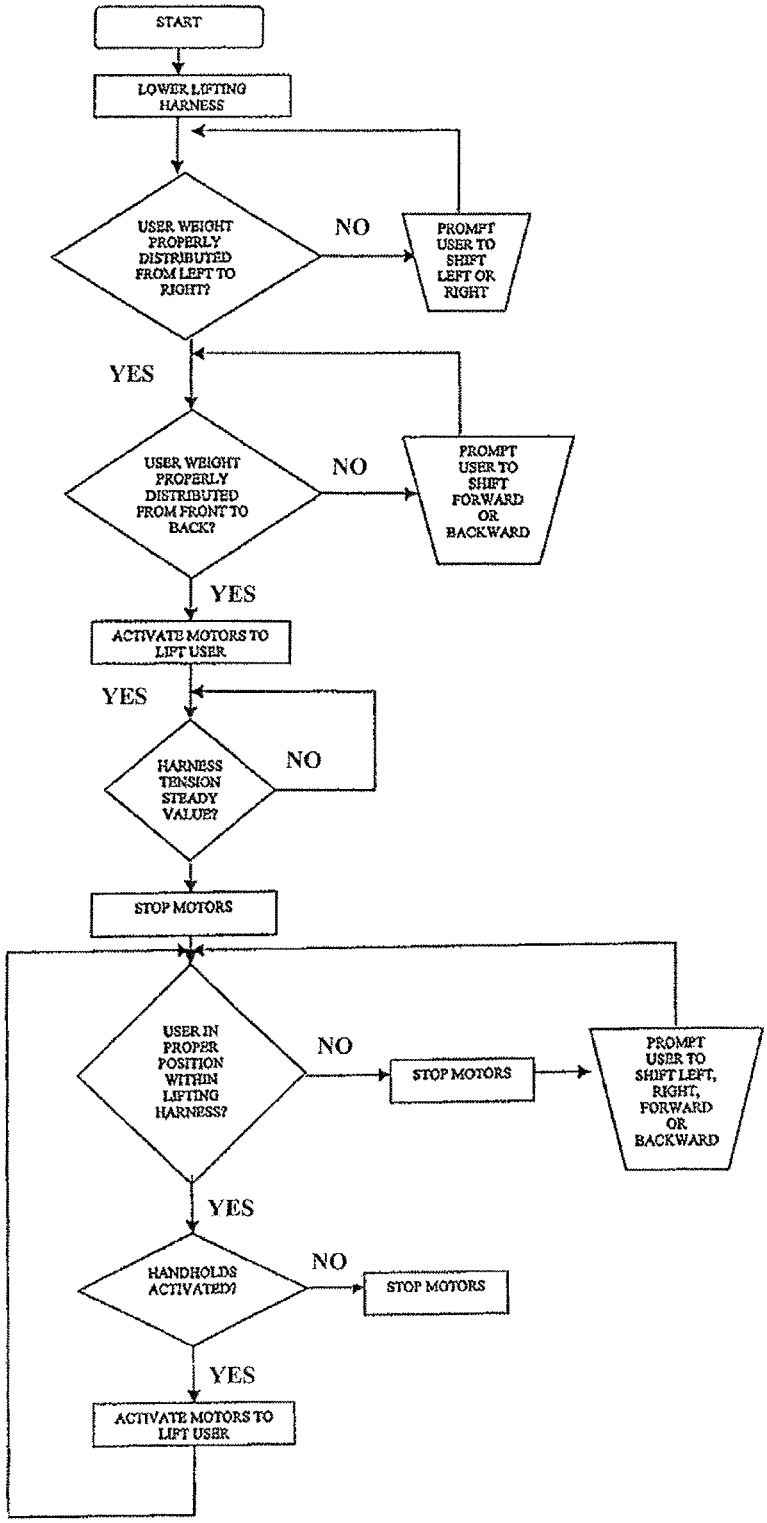
FIG. 4 is flowchart explaining operation of the stability controlled assistive lifting apparatus of FIG. 1.

Referring now to FIG. 4, operation of the illustrative embodiment of the present invention will now be described with the user being lifted from a position on the floor, without direct assistance from other person(s).

From the floor, with the present invention in close proximity to the user and upon activating the present invention using a power switch or the like, the motor unwinds the straps 43 dropping the lifting harness 10 to floor level. The user then maneuvers himself or herself to sit on the lifting harness 10, with the lifting surfaces 10*a* being arranged in a comfortable position on the back side of the user. The harness surface pressure sensors 20 measure the posture and position of the user to determine that the user is in a proper position to be lifted.

The lifting harness may be determined to be properly located when the user is seated symmetrically from side-to-side and when more of the weight is towards the front of the harness. The side-to-side symmetry is observed when the pressure distribution recorded by the pressure sensors to the right and left of the harness center is equal within a certain tolerance. The proper forward-to-back location may be observed when the pressure distribution recorded by the front pressure sensors is higher than that recorded by the rear pressure sensors by a certain predetermined value. The side-to-side symmetry is important to provide accurate harness tension readings. Locating the user towards the front of the harness insures that tipping backwards will not occur.

The user may be audio or visually prompted by the human/machine interface 61 to adjust his/her position, if any adjustment is needed, in order to ensure that the lifting harness 10 is in the proper position on the back side of the user. The visual prompts may consist of a series of lights and/or arrows. The arrows may indicate to the user the direction that he or she needs to move. The lights may provide visual cues as to which of the pressure sensors are under or overloaded. The lights could consist of a red or green LED's that allow the user to experiment with the positioning until all LED's turn green. Further still, the lifting harness may vibrate to indicate to the user an improper position.

Once the controller signals that the harness is properly located, the motors 40 are engaged to slowly lift the user. That initial lifting may be stopped when the harness tension, measured by summing the signals from the harness tension sensors 30 (denoted by $T_L$ and $T_R$ for left and right, respectively), reaches a steady value. That value is proportional to the weight of the user, denoted by W. This state is generally achieved with less that a one inch elevation off the floor. At this stage, the pressure distribution may be checked again to ensure that the harness remain properly located.

The user then grabs the handholds 71. After it is determined that the pressure being applied to the handholds 71 has reached a threshold level, the device becomes active. Upon pressing or pulling down on the handholds in order to lift up, the device may sense a drop in the harness tension recorded by the left and right tension sensors 30, given by $T_L$ and $T_R$ and computes two error terms e1 given by $W-(T_L+T_R)$ and e2 given by $T_L-T_R$. The device then proceeds to wind the left and right motors 40 in order to reestablish the previous load levels and rendering the error terms e1 and e2 nil. The speed with which the left and right motors are wound up, $S_L$ and $S_R$ respectively, may be determined by solving the system of equations given by $S_L+S_R=G_1\times(W-T_L-T_R)$ and $S_L-S_R=G_2\times(T_L-T_R)$ where $G_1$ and $G_2$ are proportionality constants. In that manner, the average winching speed is proportional to the total harness tension drop and the differential winching speed is proportional to the difference in the left and right tensions. The latter ensures the side-to-side stability of the user. The process continues as long as the user is both holding the handholds and pulling downwardly.

During the lifting and as the user becomes more upright, a significant weight transfer away from the buttocks and onto the feet occurs. That weight transfer manifests in a higher value of the error term e1 and left uncompensated may cause a dangerous positive feedback loop. The control algorithm may compensate for that condition in one of two ways. The first is through a predetermined weight transfer function that compensates for the natural drop in the weight carried at the buttocks, e.g., e1 will be given by $W'-(T_L+T_R)$ where W' is a decreasing function of harness height position. The second mechanism is by recording the left and right lifting forces $F_L$ and $F_R$ at the handholds directly in which case, the speed of the motors will be determined by solving the simultaneous equations $S_L+S_R=G_1\times(F_L+F_R)$ and $S_L-S_R=G_2\times(T_L-T_R)$. In the latter case, provisions should be made to ensure that the lifting forces on the handholds are distinguishable from the stabilizing forces that a user could exert in the effort to steady oneself.

The stability of the user against tipping forward and backward may be ensured by continuously monitoring the pressure signals on the front and back of the harness. In the event that unexpected readings occur, such as weight transfer towards the back of the harness, the algorithm may stop the motors and give the user a chance to steady him or herself.

If desired, the user could lower himself or herself down by pushing up on the handholds, causing the tension and pressure sensors to register increased pressure, and thus triggering the motors to wind the lift harness back downwardly in a controlled fashion.

What has been described and illustrated herein is an illustrative embodiment of the invention along with some of its variations. The terms, descriptions and figures used herein are set forth by way of illustration only, and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no limiting effect.

As such, those skilled in the art will appreciate that the concepts, upon which this disclosure is based, may be used as a basis for the designing of other structures, methods and systems for carrying out the several purposes of the present invention. It is important, therefore, that the claims be regarded as including such equivalent constructions.

As one example, while the above exemplary embodiment is described wherein a user is starting from a position on the floor, the user could start from any number of reclined positions, including seating on a chair, a couch, a bed or the like.

As a further example, the present invention is not limited to a single lifting harness and as such could include multiple harnesses, either independently controlled using sufficient motors or dependently controlled using a single motor with a power transmission. The addition of multiple harnesses may be preferred in complicated lifting cases.

By way of another example, while the illustrative embodiment of the present invention as described above is used to assist in the standing or sitting of a user, the present invention may be utilized in a number of other applications. For example, the present invention may be used during physical therapy in order to help improve strength and/or balance of a user. By dialing the assist amount as a percentage of body weight, the device can be used to incrementally improve the strength of a person following injury or surgery. Also, the human/machine interface could be modified to indicate the load measures at each side of the harness and prompt the user to equalize these values with the goal of improving the balance.

Further still, by way of another example, the present invention may be used to help nurses and other caregivers handle patients with diminished strength. In such a configuration, the caregiver is lifting a portion of the user's weight while the device is supplying the additional force needed to lift a patient.

By way of a further example, the above described illustrative embodiment requires that a user be properly gripping multiple handholds to activate the assistive lifting harness apparatus, however, it may be only be necessary that a single handhold be used to activate the apparatus. Further, the handholds may be a harness or harnesses wherein the user's hand(s) are placed during operation (for example, in a situation wherein a person is unable to grip a handhold due to diminished hand/arm strength or the like). Further still, an over ride switch may be provided which allows a person other than the user (such as a nurse or a caregiver) to activate the apparatus without the handholds being gripped.

As still a further example, the speed of the motors, and thus the speed at which the lifting harness is raised or lowered, may be adjustable. Such speed adjustment may be automatically controlled by the ECU or it may be user-selected.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A stability controlled assistive lifting harness apparatus, said apparatus comprising:

a frame;

an actuator attached to said frame;

a lifting harness configured to support a user and to be raised and lowered by said actuator, said lifting harness being provided with at least one surface pressure sensor located within the lifting harness which measures a force applied to a user by the lifting harness;

a handhold, said handhold including a handhold sensor;

a harness tension sensor which measures a force applied to the lifting harness by said motor; and a controller which receives outputs from said surface pressure sensor and said harness tension sensor and controls operation of said actuator based on the outputs of the surface pressure sensor and the harness tension sensor, wherein said harness is configured to be selectively fitted to various body parts of a user who is in an upright or reclined position, said controller controls operation of the actuator from moving a user between said positions, wherein activation of the actuator is semi-automatically controlled based on sensed engagement of said handhold, and said controller prevents operation of the actuator when it is determined, based on the outputs of the surface pressure sensor and the harness tension sensor, that a user is not properly positioned relative to the lifting harness.

2. The stability controlled assistive lifting apparatus of claim 1, further comprising a prompting device indicates when the user is not in a proper position relative to the lifting apparatus.

3. The stability controlled assistive lifting apparatus of claim 2, wherein the controller determines multiple aspects of the user's position relative to the lifting apparatus based on the sensor inputs and provides a warning when at least one aspect of the user's position is incorrect.

4. The stability controlled assistive lifting apparatus of claim 3, wherein the multiple aspects of the user's position includes lateral weight distribution and longitudinal weight balance.

5. The stability controlled assistive lifting apparatus of claim 1, wherein lateral weight balance of the user is determined based on pressure applied to said harness tension sensor.

6. The stability controlled assistive lifting apparatus of claim 1, wherein the handholds are equipped with at least one directional pressure sensor for sensing a direction of pressure applied thereto, whereby the lifting harness may be selectively raised or lowered when a user applies a force to said handholds.

7. The stability controlled assistive lifting apparatus of claim 1, wherein said frame swingable supports said lifting harness.

8. The stability controlled assistive lifting apparatus of claim 1, wherein said lifting harness is configured support the user while the user's feet remain in contact with the ground when the user is being assisted by said apparatus.

9. The stability controlled assistive lifting apparatus of claim 1, wherein the lifting harness comprises a plurality of surface pressure sensors located on an inner surface thereof for measuring a contact pressure between the lifting harness and a supported portion of a user.

10. The stability controlled assistive lifting apparatus of claim 9, wherein longitudinal weight balance of the user is determined based on pressure applied to said surface pressure sensors.

11. The stability controlled assistive lifting apparatus of claim 1, wherein said harness includes a pair of straps and a seat support connected between the straps, and said harness tension sensor is attached to at least one of said straps.

* * * * *